United States Patent [19]

Mourier

[11] 4,099,094

[45] Jul. 4, 1978

[54] ELECTRONIC TUBE OF MAGNETRON TYPE OPERATING AS A OSCILLATOR OR AN AMPLIFIER

[75] Inventor: Georges Mourier, Paris, France

[73] Assignee: Thomson-CSF, Paris, France

[21] Appl. No.: 751,888

[22] Filed: Dec. 17, 1976

[30] Foreign Application Priority Data

Dec. 23, 1975 [FR] France ..... 75 39527

[51] Int. Cl.[2] ..... H01J 25/34

[52] U.S. Cl. ..... 315/39.3; 315/39.51; 315/39.77

[58] Field of Search ..... 315/39.3, 39.71, 39.51, 315/39.53, 39.77

[56] References Cited

U.S. PATENT DOCUMENTS

| | | | |
|---|---|---|---|
| 2,715,697 | 8/1955 | Webber | 315/39.77 X |
| 3,069,594 | 12/1962 | Feinstein | 315/39.3 |
| 3,223,882 | 12/1965 | Thal, Jr. | 315/39.3 |
| 3,273,011 | 9/1966 | Brown | 315/39.3 X |

FOREIGN PATENT DOCUMENTS

| | | | |
|---|---|---|---|
| 750,021 | 6/1956 | United Kingdom | 315/39.77 |

*Primary Examiner*—Saxfield Chatmon, Jr.
*Attorney, Agent, or Firm*—Roland Plottel

[57] ABSTRACT

An electronic tube of magnetron type capable of operating as a self excited oscillator or an amplifier pilot-controlled to a given frequency. It comprises a waveguide surrounding the anode of the magnetron. The waveguide which comprises an output and an input is coupled at coupling points to certain cavities of the magnetron. The waveguide is formed by successive sections each extending from one of the coupling points to the next and each having a constant characteristic impedance. The guide offers to the wave a characteristic impedance which varies regularly from one of its section to the other. When operating as a self excited oscillator the input at the opposite end to the output is closed off.

8 Claims, 8 Drawing Figures

ELECTRONIC TUBE OF MAGNETRON TYPE OPERATING AS A OSCILLATOR OR AN AMPLIFIER

The present invention relates to an electronic tube of magnetron design, capable of operating as a self-excited oscillator or an amplifier pilot-controlled to a given frequency.

The tube comprises, around the anode of a magnetron of conventional design, a hollow volume with conductive walls, coupled at a certain number of points to the cavities forming the anode of the magnetron. Structures of this kind, combining such a volume with the cavities of the magnetron, have been described in the prior art by J. Feinstein and R. J. Collier in relation to the coaxial magnetron and the amplifier magnetron. See for example "Crossed-Field Microwave Devices", 2, Academic Press, 1961, pages 123–134 and 211–222.

The device in accordance with the invention differs from these above mentioned as far as the coaxial magnetron is concerned, in terms of the fact that the wave generated in the volume associated with the cavities is not a standing wave but a wave which rotates in the direction of the electrons, and, as far as the amplifier magnetron is concerned, that arrangements are made which make it possible to avoid the asymmetry generally affecting the electromagnetic field pattern within the anode space, in amplifiers of this kind, and consequently affecting the beam structure, due to the increase in the power of the waves during their propagation around the anode towards the tube output. This kind of asymmetry, because of the disturbance in thermal uniformity which it gives rise to at the surface of the cathode, is prejudicial to the service life of the tube. A particular object of the present invention is to reduce the severity of this problem.

The invention will be better understood from a consideration of the ensuing description and the attached figures in which similar elements are illustrated by similar references:

Figure 1:
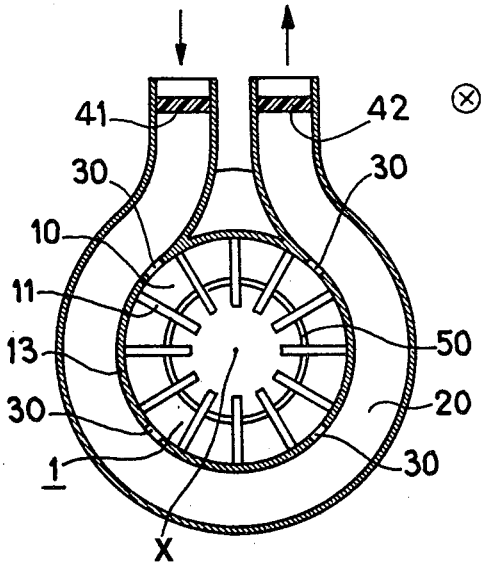
FIGS. 1 and 2 are schematic sectional views of electronic tubes of the kind to which the invention applies.

The type of tube referred to earlier is illustrated schematically in one of its variant forms, in FIG. 1, where a magnetron anode 1 made up of cavities 10 separated by walls 11 integral with a common cylindrical portion 13 of which the tube cathode (not shown) forms the centre, has been illustrated. The circled cross illustrates the magnetic field existing in the cathode-anode space, which, in the case of the figure, is directed towards the back of the figure. A waveguide 20 surrounds the anode 1 as the figure shows. The wave guide 20 is coupled by the slots 30 to certain cavities of the anode. The waveguide 20 has one of the known shapes encountered in microwave work, either a rectangular, circular, coaxial or otherwise shaped waveguide. Two sealed windows 41 and 42 make it possible to maintain the vacuum in the waveguide. In the drawing, which is a section through the central plane of the anode waveguide set perpendicularly to the axis X of the anode, the reference 50 signifies the element which couples the cavities together. In operation, a high frequency power is injected at the tube input (left-hand arrow) whilst the output power is directed in accordance with the right-hand arrow towards the load which has not been shown in the drawing. The tube illustrated operates as an amplifier pilot-controlled to the frequency of the wave injected at the input.

Figure 2:
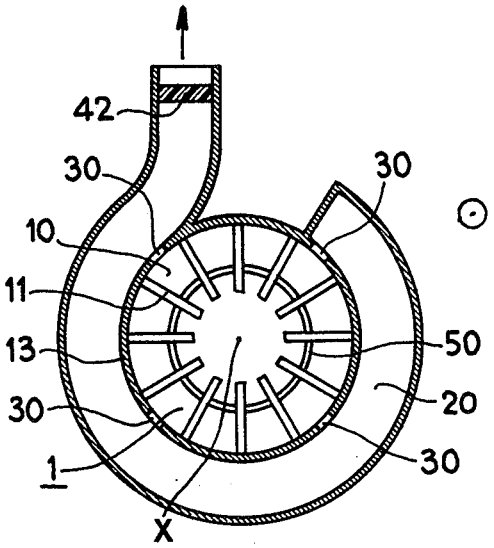

FIG. 2 is a schematic view similar to the former with the exception of the fact that the waveguide is closed off at one of its ends. The figure corresponds to another version of a tube of the same kind operating this time as a self-excited oscillator. In the case of the variant shown in this figure, the magnetic field illustrated by the dot surrounded by a circle, is directed in the forward sense.

A tube of this kind is essentially asymmetrical whether it operates as an amplifier, as in the case of the diagramm shown in FIG. 1, or as an oscillator as in the case of FIG. 2. However, as mentioned earlier on, one of the most important conditions to be fulfilled from the point of view of the service life of the tube, is that of the thermal uniformity of the cathode whose temperature is determined both by the heating power supplied to it and by the bombardment with the ions of the beam. This bombardment is asymmetrical to the extent that the beam itself is, the latter, for its part, experiencing the asymmetry which can affect the microwave field in the space defined between the cathode and the anode of the tube. Arrangements are necessary in order to the maximum extent possible to protect the cathode-anode zone from this asymmetry.

Another condition to be fulfilled in the case of amplifiers is that the power radiated by the anode to the waveguide at the points of coupling is directed in its entirety to the output, this presuming an asymmetry in the waveguide; the means of ensuring that this condition is fulfilled without resorting to standing waves, reside in developing a travelling wave at all points in the waveguide despite the discontinuities which are due to the coupling means.

In the tubes in accordance with the invention, the coupling between the anode of the magnetron and the waveguide arranged around it, is effected by means which, for reasons of simplicity of manufacture, are all chosen to be identical. These means are furthermore small in number, only a few of the cavities of the magnetron being coupled to the waveguide, again for the same reason of simplicity of construction and also to make it easy to achieve the phase condition in the travelling wave passing through the waveguide, from one slot to the next.

The structure of the tube in accordance with the invention is based upon the following considerations pertaining to the coupling between a cavity and the volume surrounding the cavities.

Figure 3:
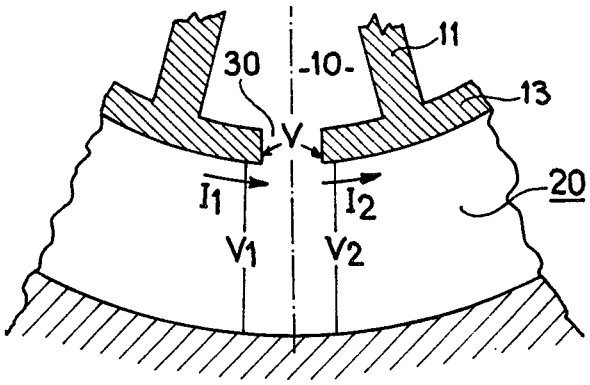
FIG. 3 is a fragment of a tube of the kind disclosed in the preceding figures.

For slot coupling, as illustrated schematically in FIG. 3, the latter being an enlarged fragment of a portion of the tube shown in FIG. 1, in the absence of any charge-accumulating elements we have the conditon $I_1 = I_2$ (1). These two quantities respectively represent the current at the surface of the wall 13 in the waveguide 20, at the left and right of the coupling slot 30. If we designate by $P_f$ the increase in the power of the wave from one side to the other of the slot, on the other hand we have $\frac{1}{2} V_2 I_2 = P_f + \frac{1}{2} V_1 I_1$ (2), $V_1$ and $V_2$ designating the voltages in the waveguide 20 respectively to the left and right of the slot as indicated in the Figure. For a waveguide of uniform section, that is to say presenting a constant characteristic impedance over the whole of its length, and for a wave other than a standing wave, on the other hand there is proportionality between these voltages and these currents (3) $V_1/I_1 = V_2/I_2 = Z_c$, $Z_c$ being the characteristic impedance of the waveguide, so that we have the condition $V_1 = V_2$ (4) and, in absence of any amplification in accordance with the equation (2) : $P_f = o$. It therefore follows that for amplification to take place, it has to be assumed that the situation in the waveguide 20 is that of standing waves, with $V_1 \neq V_2$. This kind of situation is undesirable, this for a variety of reasons amongst which the two following: It increases the risk of parasitic oscillations and consequently limits the gain of piloted tubes. In addition it complicates the phase relationship between the various points in the waveguide, this factor being sensitive in this case to the frequency and accordingly more difficult to achieve.

In addition, to ensure that the amplification takes place, it is possible to discard the condition (1) of equality between the currents by introducing into the slots an element which accumulates electrical charges. This, under the conditions under which the cavity operates, virtually without any electric field along the wall 13, means the provision of a loop, added to each slot, consisting of a conductor fixed at one of its ends to the wall 11, passing through the slot, and at the other of its ends to an electrode arranged in the waveguide opposite the slot, forming a capacitive element. If Q represents the charge on the capacitive element, then we have $I_2 = I_1 - j\omega Q$, where $\omega$ is the radian frequency corresponding to the frequency $f$ of the operation ($\omega = 2\pi f$). It will be observed, then, that if the asymmetry which has been mentioned earlier is to be avoided, different capacitances must be used for the different slots, and the slots themselves must differ from one another; this gives rise to different impedances at the location of each coupled cavity and to different phase-shifts at the location of each slot, that is to say to a certain asymmetry in addition to the complexity of the design problem.

In the tubes in accordance with the invention, the condition (3) is discarded, that is to say the constancy on the part of the characteristic impedance $Z_c$ of the waveguide; instead, an impedance which varies from one end to the other of the waveguide is accepted.

In a first family of variant embodiments of the tubes in accordance with the invention, it is accepted that $I_1 = I_2 = I_g$ in accordance with the equation (1) stated earlier, $V_1$ differing from $V_2$ however in contrast to the equation (4).

$$\text{We have: } V_2 = V_1 + V \quad (5)$$

In addition, it is accepted that:

$$V_2/Z_2 = V_1/Z_1 \quad (6)$$

$Z_2$ and $Z_1$ representing the characteristic impedances of the waveguide sections between two slots, that is to say that these impedances are constant over the complete length of a waveguide section separating two successive slots, but vary from one section to the next. The voltage V stated hereinbefore, in phase with $I_g$, has the value $2P_f/I_g$.

In these variant embodiments, the waveguide 20 is a rectangular section waveguide of a kind of well known in microwave work, whose width, that is to say its dimension in the direction of the radius of the anode, this dimension being constant along a section extending between two slots, varies from one section to the next. The characteristic impedance of the rectangular, fixed-height waveguide, in this instance its height being that of its dimensions which is perpendicular to the plane of the figure, is proportional to the width in question.

Figure 4:
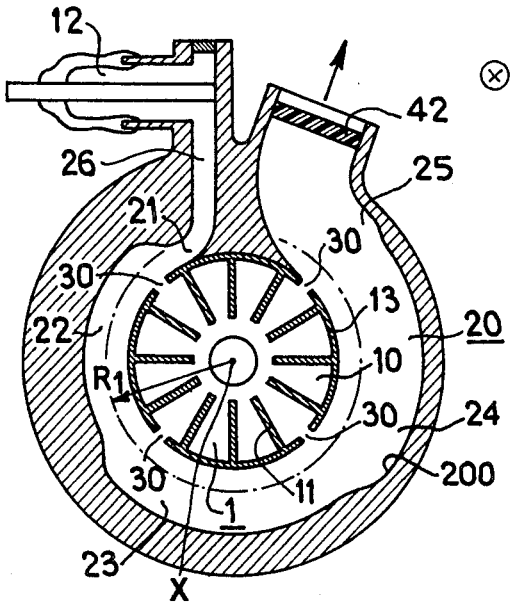
FIG. 4 is a view of the tube shown in FIG. 1 modified in accordance with the invention.

One of its variant forms has been shown schematically in FIG. 4 which, like FIGS. 1 and 2, is a section through the tube in the central plane perpendicular to the axis X of the anode.

The waveguide 20 is constituted, as the Figure shows, by successive sections 21, 22, 23, 24 and 25 whose width and characteristic impedance increase from the input working towards the output of the tube, these sections numbering 5 in the example of the figure and being connected at the location of the slots 30. The waveguide 20 is a rectangular section waveguide attached by its major side to the external wall of the anode. The shorter side or width of the waveguide has a dimension which decreases, working from one section to the next, from said output to the opposite end of the wave guide.

These characteristic impedances vary in accordance with the equation (6) in the same way as the voltages $V_1$, $V_2$, and the voltages in the following sections. It follows that the electric field in these various sections, the field being parallel for the $TE_{01}$ mode, to the width of the waveguide, has the same amplitude in all the sections. On the other hand, since, due to the constant level of the current and the magnetic field in the complex sense of the word, ($I_1 = I_2 = I_g$), the slots must not introduce any phase-shift in the voltage, it will be appreciated that the electromagnetic field is identical in all the sections except for the phase difference due to propagation; it is the same as in a waveguide exhibiting no variation in cross-section, limited to the radius $R_1$ and excited exclusively at the input. In the event that this condition, namely the absence of any phase-shift at the location of the slot, should not be strictly complied with, the situation can be remedied by adding a capacitive element to the waveguide.

In the piloted version shown in the figure, the input power is injected into the tube through the antenna 12. The reference 26 in this figure designates an impedance transformer between the antenna in question and the first waveguide section 21. The coupling element effecting the coupling between the cavities (the element 50 in FIG. 1) has not been shown in this figure. The tube described earlier is simple in design; the only asymmetrical part of the tube, in other words, is the external wall 200 of the waveguide 20.

In the example shown, only four coupling slots are provided. To improve symmetry, a slot could be provided in each cavity. However, as we have already explained, this would make the attainment of the slot-to-slot phase condition more difficult to achieve. Coupling of every second cavity to the waveguide is also conceivable within the scope of the invention, provided always that the anode does not operate in the $\pi$ mode, that is to say with antiphase fields in two successive cavities, since in this case the phase will be uniform along the length of the waveguide and this would exclude propagation.

Preferentially, coupling to the waveguide will be effected every third cavity, as in the example of the figure, or every fourth cavity or more.

Figure 5:
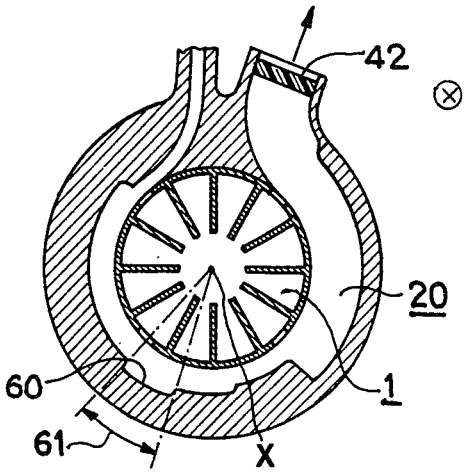
FIG. 5 is a variant embodiment of the tube of the preceding figure.

The power gain of this kind of tube, under the conditions outlined earlier, is equal to the ratio of the impedances of the last and first sections, respectively 25 and 21 in the figure. The gain is limited by the small number of sections of the waveguide 20, this being equal to that of the slots + 1, and by the corresponding impedance changes. The ratio can be increased in the tubes in accordance with the invention, by arranging half way along the length an impedance transformer of the kind marked 60, of length 61, in FIG. 5, and by arranging for different slot characteristics to be created in the right-hand portion, from those of the left-hand portion. A transformer of this kind could for example take the form of a waveguide section of the length $\lambda/4$, $\lambda$ being the centre wavelength of the tube operating band.

Using one and the same tube, different operating levels are possible, provided that at the same time as the power injected at the tube input, the power furnished by the cavities to the waveguide is modified for example by modifying the high voltage applied to the anode.

Figure 6:
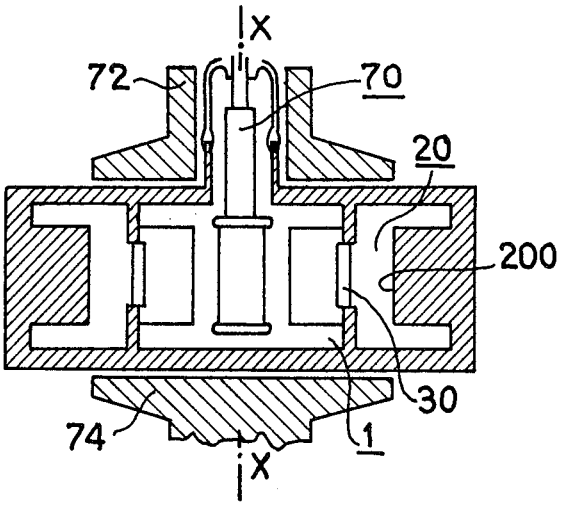
FIG. 6 is an overall sectional view of a variant embodiment of a tube in accordance with the invention.

In the foregoing, the waveguide 20 was a rectangular section waveguide. It is equally possible within the scope of the invention, to utilise a U-section waveguide, as in the example of FIG. 6 where an overall view of a tube is presented in section in a plane passing through the axis XX of the tube. The wall 200 which has been mentioned earlier, is that of the re-entrant part of the waveguide. This waveguide form, due to the reduction in bulk which it achieves in the height sense, makes it possible to employ magnetic field generating systems in which the polepieces are marked 72 and 74, and which do not substantially differ from those used for ordinary magnetrons. In the figure, 70 designates the cathode assembly.

Figure 7:
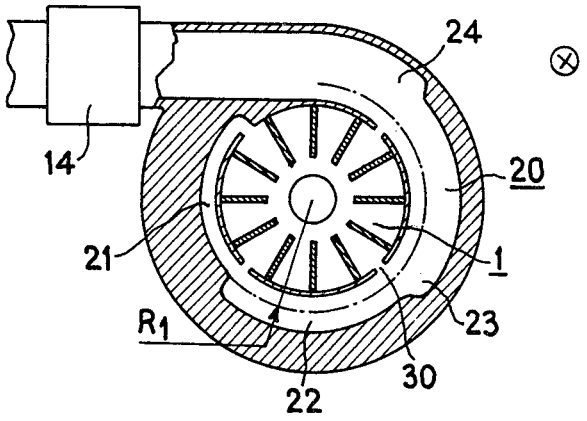
FIG. 7 is a view of the tube shown in FIG. 2, modified in accordance with the invention.

FIG. 7 is a view similar to that of FIG. 4, of a self-excited oscillator version of the same tube. The waveguide 20 is closed off at its left-hand end. In the figure, the reference 14 designates the output antenna of tube.

In another family of variant forms of the invention, the waveguide is a coaxial line. In this case, again, as in the preceding instance, in the tubes in accordance with the invention the characteristic impedance $Z_c$ of the line is variable from one end to the other. The waveguide is a coaxial line whose external conductor has a fixed internal diameter and whose internal conductor has a diameter which decreases, working from one section to the next from said output towards the opposite end.

Figure 8:
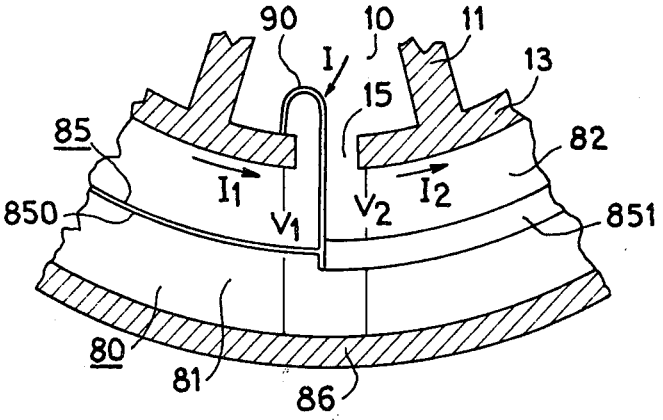
FIG. 8 is a fragment of another variant embodiment of the tube in accordance with the invention.

The coupling between the cavities and the line, is effected through a loop and shown in the fragmentary view of FIG. 8. The line, which is marked 80 in the figure, is coupled to some of the cavities, one out of every three for example, as in the foregoing variant embodiments. The reference 90 designates the loop passing through the orifice 15, one end being connected to the wall 13 and the other to the internal conductor 85 of the coaxial line whose external conductor is marked 86. The device operates at constant voltage on the line: the condition $V_1 = V_2 = V_g$ (7) applies but $I_1$ differs from $I_2$. Let us put $I_2 = I_1 + I$ (8). In this case, we have $I = 2P_f/Vg$. In one and the same section, the power (equation 2) being constant, we furthermore have (9) $I_1 Z_1 = I_2 Z_2$, where $Z_1$ and $Z_2$ represent the characteristic impedances of the left-hand section and right-hand section in the figure, for a wave propagating through the line in the direction of the arrow.

In these tubes, the line operates with a current which rises from one section to the next, and with a characteristic impedance which decrases considered in the direction of propagation of the wave. This decrease is ensured at the location of the coupling point, by an increase in the diameter of the internal conductor whose two successive sections are marked 850 and 851. In FIG. 8, only two sections, marked 81 and 82, of a coaxial line have been shown. In the case of a four-point coupling, as in the example of FIG. 4, the tube would have five.

The tubes in accordance with the invention, due to the regular variation in the impedance from one end to the other of the waveguide, achieve better symmetry on the part of the fields and the beam inside the anode space. As we have seen, this symmetry favours the attainment of a longer service life on the part of the tubes. The same symmetry, coupled with the reduction in the standing ratio and the number of parasitic modes, makes it possible to attain higher power densities and to construct tubes having a larger number of cavities, with a higher output power than is attainable with prior art tubes of the same kind.

The applications of the tubes in accordance with the invention are of the same as those of the tubes of similar structure which belong to the prior art.

Of course, the invention is not limited to the embodiments described and shown, which were given solely by way of example.

What is claimed is:

1. An electronic tube comprising:

a cathode;

an anode of the magnetron type including cavities and defining with said cathode a cathode anode space;

means for generating an electron beam and imparting to the electrons a rotary motion in said space;

a waveguide having two ends one of said ends being an output, said waveguide surrounding said anode and being coupled at coupling points to certain of the cavities of said magnetron and in which when operating an electromagnetic wave propagates in the direction of rotation of said electrons, said wave guide being formed by successive sections each extending from one of the coupling points to the next and each having a constant characteristic impedance, said wave guide is a rectangular section waveguide having a major side and a shorter side, said waveguide being attached by said major side to the external wall of said anode, its shorter side having a dimension which decreases, working from one of said sections to the next, from said output to the other of said two ends, said coupling being effected through mutually identical slots provided on said anode, said waveguide offering to said wave a characteristic impedance varying regularly from one section to the other.

2. An electronic tube as claimed in claim 1, in which said waveguide is closed off at said end opposite to said output, said tube operating as a self excited oscillator.

3. An electronic tube as claimed in claim 1, in which said end opposite to said output is an input through which when operating there is injected into said tube a high frequency power, said tube operating as an amplifier pilot-controlled to the frequency of said wave.

4. An electronic tube as claimed in claim 1 further comprising between two of said sections an impedance transformer equivalent to a transmission line of the length λ/4, λ designating the center wavelength of the tube operating band.

5. An electronic tube comprising:

a cathode;

an anode of the magnetron type including cavities and defining with said cathode a cathode anode space;

means for generating an electron beam and imparting to the electrons a rotary motion in said space;

a waveguide having two ends one of said ends being an output, said waveguide surrounding said anode and being coupled at coupling points to certain of the cavities of said magnetron and in which when operating an electromagnetic wave propagates in the direction of rotation of said electrons, said wave guide being formed by successive sections each extending from one of the coupling points to the next and each having a constant characteristic impedance, wherein said waveguide is a coaxial line comprising an external conductor and an internal conductor, said external conductor having a fixed internal diameter, said internal conductor having a diameter which decreases, working from one section to the next, from said output towards said other end, said coupling taking place by means of loops having two ends terminating at one of said ends at the wall of said cavity and at the other of said ends at said internal conductor, said waveguide offering to said wave a characteristic impedance varying regularly from one section to the other.

6. An electronic tube as claimed in claim 5, in which said waveguide is closed off at said end opposite to said output, said tube operating as a self excited oscillator.

7. An electronic tube as claimed in claim 5, in which said end opposite to said output is an input through which when operating there is injected into said tube a high frequency power, said tube operating as an amplifier pilot-controlled to the frequency of said wave.

8. An electronic tube as claimed in claim 5 further comprising between two of said sections an impedance transformer equivalent to a transmission line of the length λ/4, λ designating the center wavelength of the tube operating band.

* * * * *